US006763793B2

(12) United States Patent
Murata et al.

(10) Patent No.: US 6,763,793 B2
(45) Date of Patent: Jul. 20, 2004

(54) VALVE SYSTEM FOR INTERNAL COMBUSTION ENGINE

(75) Inventors: Shinichi Murata, Okazaki (JP); Toshihiko Oka, Anjyo (JP)

(73) Assignee: Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/443,988

(22) Filed: May 23, 2003

(65) Prior Publication Data

US 2004/0016413 A1 Jan. 29, 2004

(30) Foreign Application Priority Data

May 24, 2002 (JP) ..... 2002-151362
May 24, 2002 (JP) ..... 2002-151363

(51) Int. Cl.[7] ..... F01L 1/18

(52) U.S. Cl. ..... 123/90.39; 123/90.16; 123/90.4; 123/90.41; 123/90.44

(58) Field of Search ..... 123/90.39, 90.4, 123/90.41, 90.44, 90.16, 90.15, 90.18; 74/559, 569

(56) References Cited

U.S. PATENT DOCUMENTS 5,386,806 A * 2/1995 Allen et al. ..... 123/90.16
6,467,443 B1 * 10/2002 Tsuruta et al. ..... 123/90.16
6,591,798 B2 * 7/2003 Hendriksma et al. .... 123/90.16

FOREIGN PATENT DOCUMENTS

JP 2001-41017 A 2/2001

* cited by examiner

*Primary Examiner*—Thomas Denion
*Assistant Examiner*—Ching Chang
(74) *Attorney, Agent, or Firm*—Birch, Stewart, Kolasch & Birch, LLP

(57) ABSTRACT

A valve system has a piston mounted in a cylinder in one of first and second rocker arms and is adapted to be forced by a return spring, and an engagement projection formed in the other one of the first and second rocker arms and is adapted to abut the piston to cause both of the first and second rocker arms to move in conjunction with each other. The return spring is disposed eccentrically with respect to the piston in such a direction as to get away from the engagement projection. Therefore, it is possible to ensure a sufficient stiffness of a power transmitting section of the valve system and a sufficient valve lift.

7 Claims, 6 Drawing Sheets

VALVE SYSTEM FOR INTERNAL COMBUSTION ENGINE

This application incorporates by reference the subject matter of Application No. 2002-151361 filed in Japan on May 25, 2002, on which a priority claim is based under 35 U.S.C. § 119(a).

BACKGROUND OF THE INVENTION

1. Field of the Invention

The present invention relates to a valve system for an internal combustion engine, which is capable of opening and closing intake valves and exhaust valves of the internal combustion engine at different timings according to operating states of the internal combustion engine.

2. Description of the Related Art

In recent years, a valve system (also referred to as a "variable valve system"), which is capable of changing operating characteristics (such as opening/closing timing, opening time, and so forth) of intake valves and exhaust valves (hereinafter generically referred to as "engine valves" or "valves") provided in a reciprocating internal combustion engine (hereinafter referred to as "engine") to the optimum characteristics according to engine load and speed, have been developed and put into practical use.

As an example of a mechanism for changing operating characteristics as described above, a variable valve system is disclosed in Japanese Laid-Open Patent Publication (Kokai) No. 2001-41017. This variable valve system is comprised of a connection mechanism constructed such that a low-speed rocker arm is provided with a hydraulic piston, and an engagement projection formed in a high-speed rocker arm is selectively engaged with the piston such that the valve timing can be switched between a low speed and a high speed.

This variable valve system is also provided with a return spring that forces the piston toward the bottom of a cylinder. In the state in which oil pressure is not applied to the piston, the piston is forced by the return spring and is held at a position in the cylinder, where the piston is not engaged with the engagement projection of the high-speed rocker arm.

It is therefore an object of the present invention to provide a valve system for an internal combustion engine, which is capable of switching the timing of an engine valve by a piston provided with a return spring and whose position can be switched, and a member abutted on the piston to move in corporation with the piston, while ensuring a sufficient stiffness of a power transmitting section of the valve system and a sufficient valve lift.

SUMMARY OF THE INVENTION

To attain the above object, the present invention provides a valve system for an internal combustion engine that has: a first rocker arm supported by a first rocker shaft such that the first rocker arm rocks with respect to first rocker shaft when driven by a first cam, the first rocker arm having an end thereof connected to one of an intake valve and an exhaust valve; a second rocker arm supported by the first rocker shaft adjacent to the first rocker arm such that the second rocker arm rocks when driven by a second cam having a different cam profile from that of the first cam; a cylinder formed in one of the first and second rocker arms; a piston slidably mounted in the cylinder; an engagement projection provided in a manner being projected from the other one of the first and second rocker arms and is capable of being engaged with an engagement part formed in the piston; and a piston position switching device that switches a position of the piston between an engagement position where the engagement projection is engaged with the piston and a disengagement position where the engagement projection is not engaged with the piston.

With the above arrangement, when the piston position switching devices positions the piston at the engagement position, the engagement projection projected from the other one of the first and second rocker arms is engaged with the engagement part formed in the piston, so that the first and second rocker arm rock integrally with each other to open and close one of the intake valve and the exhaust valve according to the cam profile of the second cam. On the other hand, when the piston position switching devices positions the piston at the disengagement position, the engagement projection projected from the other one of the first and second rocker arms is engaged with the engagement part formed in the piston, so that one of the first and second rocker arm rock independently of each other to open and close one of the intake valve and the exhaust valve according to the cam profile of the first cam.

Further, the piston position switching device is comprised of a return spring that urges the piston towards the disengagement position, and the return spring is disposed in a manner being eccentric from the piston in such a direction as to get away from the engagement projection. With this arrangement, it is possible to easily ensure a sufficient stroke of the engagement projection in such a range as not to interfere with the return spring, and even in the case where the return spring is disposed inside the engagement part formed in the piston, it is possible to easily ensure a sufficient thickness of the engagement part.

As a result, it is possible to enable the engagement projection of the second rocker arm to move in a wide range, and to ensure a sufficient valve lift when the first rocker arm is operated according to the cam profile of the second high-speed cam.

BRIEF DESCRIPTION OF THE DRAWINGS

The nature of this invention, as well as other objects and advantages thereof, will be described in the following with reference to the accompanying drawings, in which like reference character designate the same or similar parts throughout the figures and wherein.

DESCRIPTION OF THE PREFERRED EMBODIMENTS

Embodiments of the present invention will now be described in detail with reference to the accompanying drawings.

First, a description will be given of a first embodiment.

Figure 1A:
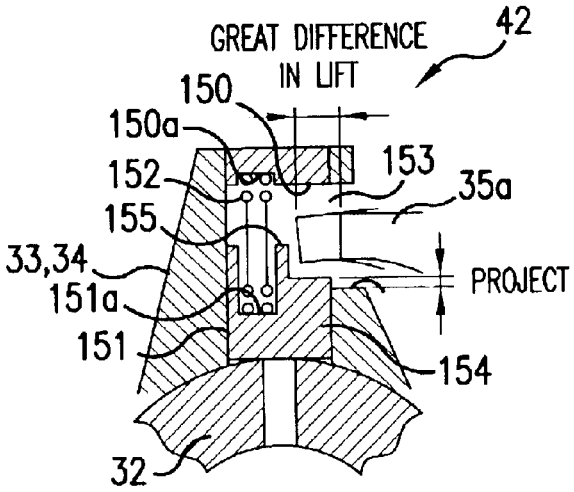
FIG. 1 is a set of sectional views schematically showing the essential parts (piston position switching device) of a valve system for an internal combustion engine according to a first embodiment of the present invention, wherein FIG. 1(*a*) is a longitudinal sectional view showing a state in which a piston is positioned at a disengagement position, FIG. 1(*b*) is a longitudinal sectional view showing a state in which the piston is positioned at an engagement position, and FIG. 1(*c*) is a cross-sectional view showing a state in which the piston is positioned at the engagement position (sectional view taken along the arrow IC—IC in FIG. 1B)
Figure 1B:
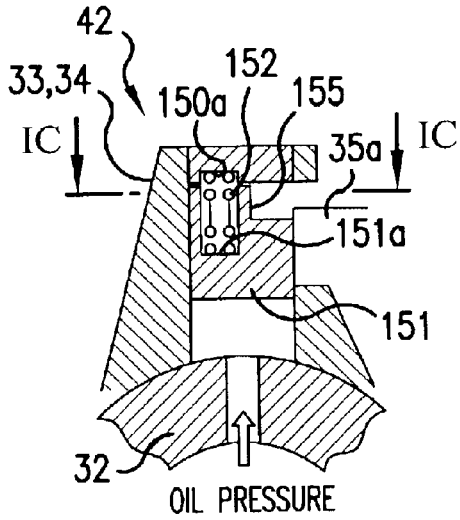
Figure 1C:
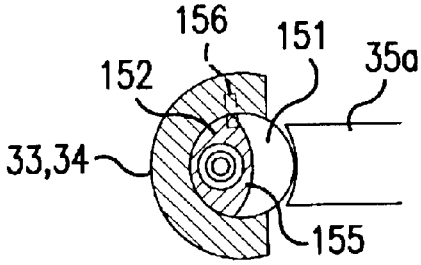
Figure 2:
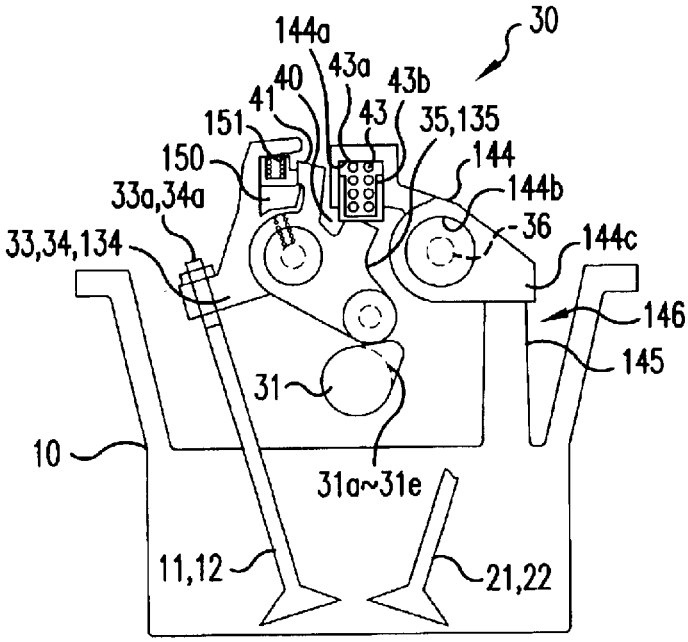
FIG. 2 is a side view schematically showing the inside of a cylinder head in a valve system for an internal combustion engine according to the first embodiment.

FIGS. 1 and 2 illustrate a valve system for an internal combustion engine according to the first embodiment. As shown in FIGS. 1 and 2, a cylinder head 10 in the upper part of each cylinder of an engine is provided with two intake vales 11 and 12 and two exhaust valves 21 and 22. The valve system 30 is provided to drive the intake valves 11 and 12 and the exhaust valves 21 and 22.

The valve system 30 is comprised of an intake valve driving system that drives the intake valves 11 and 12 and an exhaust valve driving system that drives the exhaust valves 21 and 22. The intake valve driving system is comprised of a cam shaft 31, having cams 31*a* to 31*c* installed fixedly on the cam shaft 31, an intake rocker shaft (first rocker shaft) 32, and rocker arms 33 to 35 rotatably supported on the rocker shaft 32 so that it may be rocked by the cams 31*a* to 31*c*.

The exhaust valve driving system is comprised of the cam shaft 31 shared with the intake valve driving system, cams 31*d* and 31*e* installed fixedly on the cam shaft 31, an exhaust rocker shaft 36 (second rocker shaft), rocker arms 37 and 38 (omitted from FIG. 1) rotatably supported on the rocker shaft 36 so that they may be rocked by the cams 31*d* and 31*e*.

Further, the intake valve driving system of the valve system 30 is provided with a variable valve system 40 including a connection switching mechanism 41.

Specifically, the rocker arms (first rocker arms) 33 and 34, among the rocker arms 33 to 35 of the intake valve driving system, have adjusting screws 33*a* and 34*a*, respectively, provided at an end thereof and abuts against respective stem ends of the intake valves 11 and 12. The intake valve 11 is opened and closed in response to the rocking movement of the rocker arm 33, and the intake valve 12 is opened and closed in response to the rocking movement of the rocker arm 34.

The rocker arm 33 has a roller 33*b*, provided at the other end thereof, that abuts the low-speed cam (first cam) 31*a* having a low-speed cam profile suitable for low-speed rotation of the engine. When the rocker arm 33 rocks in response to the movement of the low-speed cam 31*a*, the intake valve 11 is opened with such characteristics as indicated by an alternate long and short dashes line in FIG. 10(*a*).

The rocker arm 34 has a roller 34*b*, provided at the other end thereof, that abuts the low-speed cam (first cam) 31*b* having a low-speed cam profile suitable for low-speed rotation of the engine. When the rocker arm 34 rocks in response to the movement of the low-speed cam 31*b*, the intake valve 11 is opened with such characteristics as indicated by a solid line in FIG. 10(*b*).

Figure 10A:
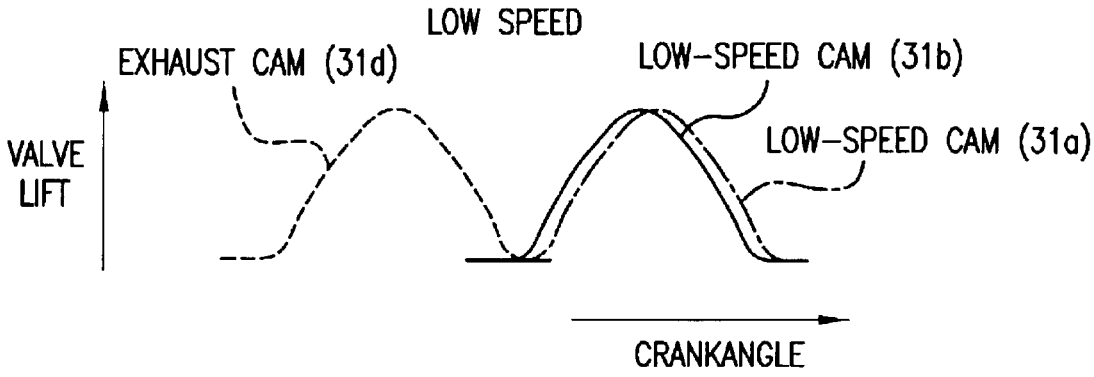
FIG. 10 is a set of graphs showing valve characteristics of the valve system for the internal combustion engine according to the embodiments of the present invention, wherein FIG. 10(*a*) shows the characteristics at a low speed and FIG. 10(*b*) shows the characteristics at a high speed.
Figure 10B:
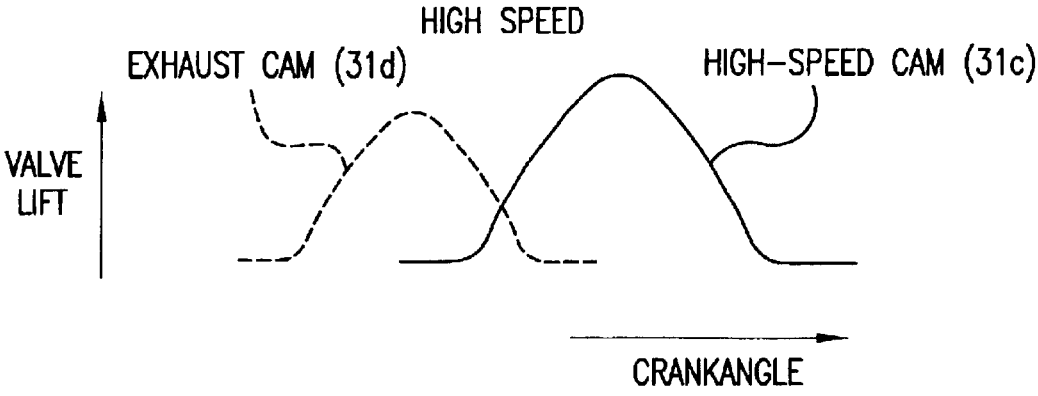

Incidentally, although in FIG. 10(*a*), the valve lift phases of the two low-speed cams 31*a* and 31*b* are different. This is only an example and the valve lift phases of the two low-speed cams 31*a* and 31*b* may be identical.

On the other hand, the rocker arm (second rocker arm) 35 has an engagement projection 35*a* formed at one end thereof and capable of being engaged with the rocker arms 33 and 34. The rocker arm 35 has a roller 35*b* provided at the other end thereof and abuts the high-speed cam (second cam) 31*c* having a high-speed cam profile suitable for high-speed rotation of the engine.

A cylinder 150 provided with an opening 153 is formed in a part of the rocker arms 33 and 34 on which one end of the rocker arm 35 can be abutted. The cylinder 150 has a piston 151 incorporated therein. Incidentally, the shape of the opening 153 is not limited to the present embodiment. The opening 153 may have any shapes insofar as it can ensure a space where the engagement projection 35*a* is capable of rocking.

Pressure oil (in the present embodiment, lubricating oil is used as pressure oil) is supplied to the cylinder 150 via oil passages 32*a* and 32*b* from the rocker shaft 32. When the internal oil pressure of the cylinder 150 is increased, the piston 151 is driven by oil pressure received at one end thereof to project to such a position as to close the opening 153 as shown in FIG. 1(*b*).

On the other hand, if the internal oil pressure of the cylinder 150 is decreased, a return spring 152 forces the piston 151 to recede to a position out of the opening 153 as shown in FIG. 1(*a*).

The piston 151 in the cylinder 150 and an oil pressure control unit 42 that controls the internal oil pressure of the cylinder 150 constitute the connection switching mechanism 41 that connects or disconnects the rocker arms 33 and 34 to and from the rocker arm 35. The connection switching mechanism 41 and the intake valve driving system constitute the variable valve system 40.

Figure 9:
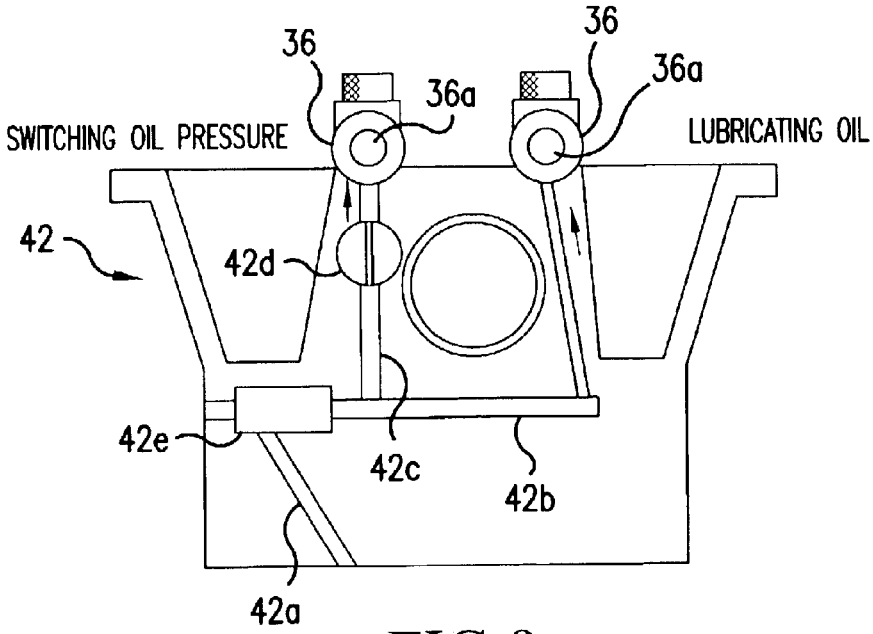
FIG. 9 is a sectional view schematically showing an oil pressure control mechanism of a connection switching mechanism in the valve system for the internal combustion engine according to the embodiments of the present invention.

It should be noted that, as shown in FIG. 9, the oil pressure control unit 42 is comprised of lubricating oil supply passages 42*a* to 42*c*, through which lubricating oil pumped from an oil pan (not shown) provided in the lower part of the engine to a cylinder block 10, for supplying oil to the oil passage 32*a* in the rocker shaft 32; an oil control valve 42*d* placed in the lubricating oil supply passage 42*c*; and a controller (not shown) that controls the opening amount of the oil control valve 42*d*. A filter 42*e* is disposed in the lubricating oil supply passages 42*a* and 42*b* so that lubricating oil can be filtered and then supplied into the cylinder 150.

With the above arrangement, when the oil pressure control unit 42 decreases the internal oil pressure of the cylinder 150, the piston 151 is receded (refer to FIG. 1A) to form a space in the opening 153 of the cylinder 150. Therefore, the engagement projection 35*a* formed at one end of the rocker arm 35 enters the space in the opening 153, but is never brought into contact with the rocker arms 33 and 34.

As a result, the rocker arms 33 and 34 rock in response to the movement of the respective corresponding cams 31*a* and 31*b* to open and close the intake vales 11 and 12 as indicated by the alternate long and short dash line or the solid line in FIG. 10(*a*).

On the other hand, when the oil pressure control unit 42 increases the internal oil pressure of the cylinder 150, the piston 151 is projected (refer to FIG. 1B) into the openings 153 of the cylinder 150. When the rocker arm 35 is rocking, the engagement projection 35*a* formed at one end of the rocker arm 35 abuts against the piston 151 to rock the rocker arms 33 and 34 via the pistons 151.

On this occasion, the rocker arms 33 and 34 are driven by the rocker arm 35 to rock in response to the movement of the high-speed cam 31*c* while getting away from the respective corresponding cams 31*a* and 31*b*. As a result, the intake valves 11 and 12 are opened with such characteristics as indicated by a solid line in FIG. 10(*b*) in a manner suitable for high-speed rotation of the engine.

Thus, the oil pressure control unit 42 functions as a piston position switching device that switches the position of the piston 151 between an engagement position where the engagement projection 35*a* is engaged with the piston 151 and a disengagement position where the engagement projection 35*a* is not engaged with the piston 151.

Incidentally, in the valve system according to the present embodiment, a coil-shaped return spring 152 is disposed eccentrically with respect to the piston 151 and the cylinder 150 in such a direction as to get away from the engagement projection 35*a*.

Specifically, as shown in FIGS. 1(*a*) to 1(*c*), the piston 151 has one end thereof formed with a concaved area 150*a* which is circular as viewed from the front, so that one end (in the present embodiment, the lower end) of the return spring 152 can be housed in the concaved area 151*a*. On the other hand, the cylinder 150 has one end thereof (in the present embodiment, the downward facing surface in the upper part) formed with a concaved area 150*a* which is circular as viewed from the front, so that the other end (in the present embodiment, the upper end) of the return spring 152 can be housed in the concaved area 150*a*.

However, the concaved areas 151*a* and 150*a* are formed eccentrically with respect to the respective axes of the piston 151 and the cylinder 150 in such a direction as to get away from the engagement projection 35*a*. Accordingly, the return spring 152 having both ends locked in the concaved areas 151*a* and 150*a* is also disposed eccentrically with respect to the engagement projection 35*a*.

Due to the eccentric arrangement, a part (engagement surface) 154 of a side of the piston 151 around the concaved area 151*a*, with which the engagement projection 35*a* is to be engaged, is thicker.

Therefore, when the piston 151 is positioned at the engagement position, the thicker engagement surface 154 is positioned inside the opening 153 of the cylinder 150, so that the engagement projection 35 is engaged with the engagement surface 154. Incidentally, when the piston 151 is positioned at the disengagement position, the piston 151 is receded (embedded) such that it is housed in the cylinder 150, so that the thick engagement surface 154 comes out of the opening 153 of the cylinder 150.

Further, a spring guard part 155 is provided on the side of the piston 151, with which the engagement projection 35*a* is to be engaged, such that the spring guard part 155 is located closer to the head of the piston 151 than the engagement surface 154.

When the piston 151 is in the disengagement position, the spring guard part 155 is positioned on an extension of the moving path of the engagement projection 35*a*, that is, in the opening 153 of the cylinder 150. Normally, the spring guard part 155 is not brought into contact with the engagement projection 35*a*.

However, when the connection switching mechanism 41 is not operated, there is the possibility that an abnormal condition occurs in which any of the rocker arms 33, 34, and 35 is not driven in response to the movement of the corresponding cam 31*a*, 31*b*, or 31*c*, and the relative positional relationship between the engagement projection 35*a* and the piston 151 is changed to cause the engagement projection 35*a* to enter the piston 151 toward the return spring 152.

In such an event, since the spring guard part 155 protects the return spring 152, the engagement projection 35*a* is not brought into contact with the return spring 152, so that the return spring 152 can be prevented from being damaged by the contact with the engagement projection 35*a*.

Specifically, neither the piston 151 nor the return spring 152 interferes with the engagement projection 35*a* when the piston 151 lies at the engagement position in a normal condition in which the rocker arms 33, 34, and 35 are driven in response to the movement of the cams 31*a*, 31*b*, and 31*c*.

In the present embodiment, since the spring guard 155 is provided to protect the return spring 152 inside the piston 151, it is possible to prevent the return spring 152 from being damaged when the above-described abnormal condition occurs.

Incidentally, the outer circumference of the piston 151 including the engagement surface 154 except for the spring guard part 155 is comprised of a cylindrical surface as shown in FIG. 1(*c*), and the surface of the spring guard 155 is also comprised of a partial convex cylindrical surface eccentric from the axis of the piston 151.

A locking pin 156 that prevents the piston 151 from rotating inside the cylinder 150 is disposed between the piston 151 and the cylinder 150. Specifically, the locking pin 156 is projected from one of the piston 151 and the cylinder 150, and an engagement groove with which the locking pin 156 is engaged is formed in the other one of the piston 151 and the cylinder 150, so that the piston 151 is inhibited from rotating inside the cylinder 150 while the piston 151 is allowed to move in the axial direction.

On the other hand, the leading end face of the engagement projection 35*a*, which abuts the engagement surface 154 comprised of the convex cylindrical surface and brought into contact with the engagement surface 154, is comprised of a concaved cylindrical surface corresponding to the engagement surface 154 (however, having a slightly larger diameter than the engagement surface 154), so that the engagement projection 35*a* can be surely brought into line contact with the engagement surface 154.

Incidentally, the rocker arms (first rocker arms) 33 and 34 are forced by return springs, not shown, respectively provided in the intake valves 11 and 12 such that the rocker arms 33 and 34 can be prevented from getting away from the respective corresponding cams 31*a* and 31*b*, whereas the rocker arm (second rocker arm) 35 is not forced by any return spring. For this reason, as shown in FIG. 2, the arm spring 43 is provided to serve as the forcing member that prevents the rocker arm 35 from getting away from the cam 31*c*.

It should be noted that the arm spring 43 is comprised of a spring main body 43*a* and a casing 43*b* having the spring main body 43*a* incorporated therein, such that the force of the spring main body 43*a* can be transmitted to the rocker arm 35 via the casing 43*b*.

The arm spring 43 is mounted in a concave 144*a* formed at one end of a holder 144, and is supported by the holder 144. The holder 144 has a shaft hole 144*b* which is formed at the intermediate part thereof and into which the rocker shaft (support shaft) 36 supporting the exhaust rocker arms (third rocker arms) 37 and 38 is inserted, and is rotatably supported on the rocker shaft 36. The holder 144 has the other end 144*c* thereof abutted on a rib (support) 145 which is installed on the cylinder head 10 in a standing condition.

Specifically, since the holder 144 is rotatably supported on the rocker shaft 36, the holder 144 is rotated when supporting the arm spring 43. To solve this problem, a locking structure 146 for inhibiting the holder 144 from rotating about the rocker shaft 36 is provided which is comprised of the rib 145 and the other end (abutment part) 144*c* abutted on the rib 145 so that the locking structure 146 can restrict the rotation of the holder 144 in such a way as to support the arm spring 43.

Since the valve system for the internal combustion engine according to the first embodiment of the present invention is constructed as described above, when the oil pressure control unit (piston position switching unit) 42 increases the internal oil pressure of the cylinder 150, the engagement surface 154 of the piston 151 projects into the opening 153 of the cylinder 150 (refer to FIG. 1(*b*)).

Therefore, when the rocker arm 35 is rocking in the state in which the piston 151 is projected, the engagement projection 35*a* formed at one end of the rocker arm 35 abuts the engagement surface of the piston 151 to rock the rocker arms 33 and 34 via the piston 151.

Namely, the connection switching mechanism 41 is brought into a state of connecting the rocker arms 33 and 34 to the rocker arm 35, so that the intake rocker arms 33 and 34 rock integrally with the rocker arm 35 to open and close the intake vales 11 and 12 according to the cam profile of the high-speed cam 31*c*.

On the other hand, when the oil pressure control unit (piston position switching unit) 42 decreases the internal oil pressure of the cylinder 150, the pistons 33*e* and 34*e* recede (disengagement position) to form a space in the opening 153 of the cylinder 150 (refer to FIG. 1(*a*)).

Thus, when the rocker arm 35 is rocking, the engagement projection 35*a* formed at one end of the rocker arm 35 enters the space in the opening 153, but is not brought into contact with the rocker arms 33 and 34. Therefore, the connection switching mechanism 41 is brought into a state of disconnecting the rocker arms 33 and 34 from the rocker arm 35, such that the intake rocker arms 33 and 34 rock without being affected by the movement of the rocker arm 35 to open and close the intake vales 11 and 12 according to the cam profile of the low-speed cam 31*a* or 31*b*.

In the valve system according to the present embodiment, the return spring 152 in the piston 151 is eccentrically disposed in such a direction as to get away from the engagement projection 35*a*. This enables the engagement projection 35*a* to move in a wider range without interfering with the return spring 52, and when the rocker arms 33 and 34 are operated in response to the movement of the high-speed cam 31*c* through the operation of the rocker arm 35, a sufficient valve lift can be ensured.

Further, since the return spring 152 is eccentrically disposed, the engagement surface 154 of the piston 151 on which the engagement projection 35*a* of the rocker arm 35 abuts is thick. For this reason, even in the case where a valve lift load is applied to the engagement surface 154 when the engagement projection 35*a* presses the engagement surface 154, the engagement surface 154 is unlikely to be deformed, and a sufficient stiffness of a power transmitting section of the valve system can be ensured.

Therefore, the valves can be driven according to the cam profile, such that the valve system can surely exercise its capabilities.

Further, a torsion spring may be used in place of the return spring 152 that forces the piston 151 to the disengagement position, but in this case, the torsion spring may be brought into contact with the rocker arms and may be worn or damaged. In view of this, if the return spring 152 is comprised of a coil-shaped spring as in the present embodiment, it is possible to prevent spring wear and damage.

Further, even if the engagement projection 35*a* enters the piston 151 toward the return spring 152, the spring guard 155 protects the return spring 152 to inhibit the engagement projection 35*a* from being brought into contact with the return spring 152, thus preventing damage to the return spring 152.

Further, the engagement surface 154 on the outer circumference of the piston 151 is comprised of the convex cylindrical surface, and the leading end face of the engagement projection 35*a*, which abuts the engagement surface 154, is comprised of the concaved cylindrical surface corresponding to the engagement surface 154 and having a slightly larger diameter than the engagement surface 154. Therefore, the engagement projection 35*a* can be surely brought into line contact with the engagement surface 154, such that the rocker arms 33 and 34 can move in response to the movement of the rocker arm 35 in a reliable and proper manner.

Further, since the surface of the spring guard part 155 is also comprised of the convex cylindrical surface, the engagement projection 35*a* is capable of moving in a wider range.

A description will now be given of a second embodiment of the present invention.

Figure 3:
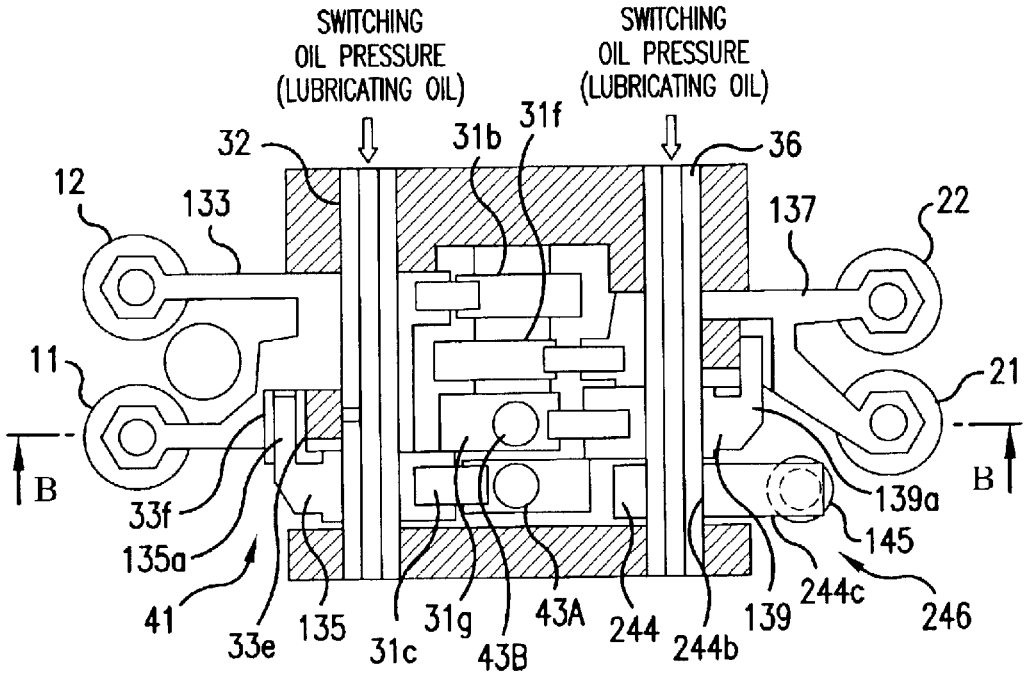
FIG. 3 is a sectional view (corresponding to FIG. 4) schematically showing the inside of a cylinder head in a valve system for an internal combustion engine according to a second embodiment of the present invention.

FIG. 3 is a sectional development (corresponding to FIG. 2) schematically showing a valve system for an internal combustion engine according to the present embodiment. In FIG. 3, elements and parts corresponding to those of FIGS. 1 and 2 are denoted by the same reference numerals.

In the present embodiment, both the intake valve driving system and the exhaust valve driving system are configured as variable valve trains.

Specifically, a rocker arm (first rocker arm) 133 rocked by the low-speed cam 31*b* and a rocker arm (second rocker arm) 135 rocked by the high-speed cam 31*c* are rotatably supported on the intake rocker shaft 32 such that they may rock.

A first connection switching mechanism (intake connection switching mechanism) 41*a* constructed in the same manner as the connection switching mechanism 41 of the first embodiment is disposed between the rocker arm 133 and the rocker arm 135.

One end of the rocker arm 133 is bifurcated so as to drive the respective intake valves 11 and 12. When the first connection switching mechanism 41*a* lies in a state of disconnecting the rocker arm 133 from the rocker arm 135, the rocker arm 133 rocks according to the cam profile of the low-speed cam 31*b* without being affected by the movement of the rocker arm 135 to open and close the intake vales 11 and 12 in a manner suitable for low-speed rotation of the engine as indicated by the solid line in FIG. 10(*a*).

When the first connection switching mechanism 41*a* lies in a state of connecting the rocker arm 133 to the rocker arm 135, the rocker arm 133 rocks integrally with the rocker arm 135 according to the cam profile of the high-speed cam 31*c* via an engagement projection 135*a* of the rocker arm 135 to open and close the intake valves 11 and 12 in a manner suitable for high-speed rotation of the engine as indicated by the solid line in FIG. 10(*b*).

On the other hand, a rocker arm 137 rocked by a low-speed cam (third cam) 31*f* and a rocker arm 139 rocked by a high-speed cam (fourth cam) 31*g* are rotatably supported on the exhaust rocker shaft 36 such that the rocker arms 137 and 139 may rock. A second connection switching mechanism (exhaust connection switching unit) 41*b* constructed in the same manner as the connection switching mechanism 41 of the first embodiment is disposed between the rocker arm 137 and the rocker arm 139.

One end of the rocker arm 137 is bifurcated so as to drive the respective exhaust valves 21 and 22. When the second connection switching mechanism 41*b* lies in a state of disconnecting the rocker arm 137 from the rocker arm 139, the rocker arm 137 rocks according to the cam profile of the low-speed cam 31*f* without being affected by the movement of the rocker arm 139 to open and close the exhaust vales 21 and 22 in a manner suitable for low-speed rotation of the engine.

When the second connection switching mechanism 41*b* lies in a state of connecting the rocker arm 137 to the rocker arm 139, the rocker arm 137 rocks integrally with the rocker arm 139 according to the cam profile of the high-speed cam 31*g* via an engagement projection 139*a* of the rocker arm 139 to open and close the exhaust valves 21 and 22 in a manner suitable for high-speed rotation of the engine.

Further, as shown in FIG. 3, the rocker arm (second rocker arm) 135 and the rocker arm 139 are provided with respective arm springs 43A and 43B as first and second forcing members which prevent the rocker arms 135 and 139 from getting away from the respective corresponding cams 31*c* and 31*g*.

Incidentally, in the oil pressure control unit (piston position switching device) 42 of each of the connection switching mechanisms 41*a* and 41*b*, as is the case with the first embodiment, the return spring 152 that forces the piston 151 to the disengagement position is disposed eccentrically with respect to the piston 151 and the cylinder 150 in such a direction as to get away from the engagement projection 35*a*, the engagement surface 154 of the piston 151 is thickly formed, and the spring guard part 155 is thinly formed in a manner being concaved to a larger degree than the engagement surface 154.

Since the valve system for the internal combustion engine according to the second embodiment of the present invention is constructed as described above, as is the case with the first embodiment, the engagement projection 35*a* is capable of moving in a wider range without interfering with the return spring 52 due to the eccentric disposition of the return spring 152, and when the rocker arms 33 and 34 are operated in response to the movement of the high-speed cam 31*c* through the operation of the rocker arm 35, a sufficient valve lift can be ensured.

Further, since in the valve system for the internal combustion engine, according to the second embodiment of the present invention, the engagement surface 154 is thickly formed, a sufficient stiffness of a power transmitting section of the valve system can be ensured, and the valve system can surely exercise its capabilities.

In this way, it is possible to suppress the increase in the size of the piston as well as the increase in the size and weight of the valve system and the driving power required for switching the position of the piston, and to ensure a sufficient elasticity of the return spring, while offering the same advantages as in the first embodiment.

Further, even when the engagement projection 35*a* enters the piston 151 toward the return spring 152, the spring guard part 155 protects the return spring 152 to prevent the damage to the return spring 152.

Figure 4:
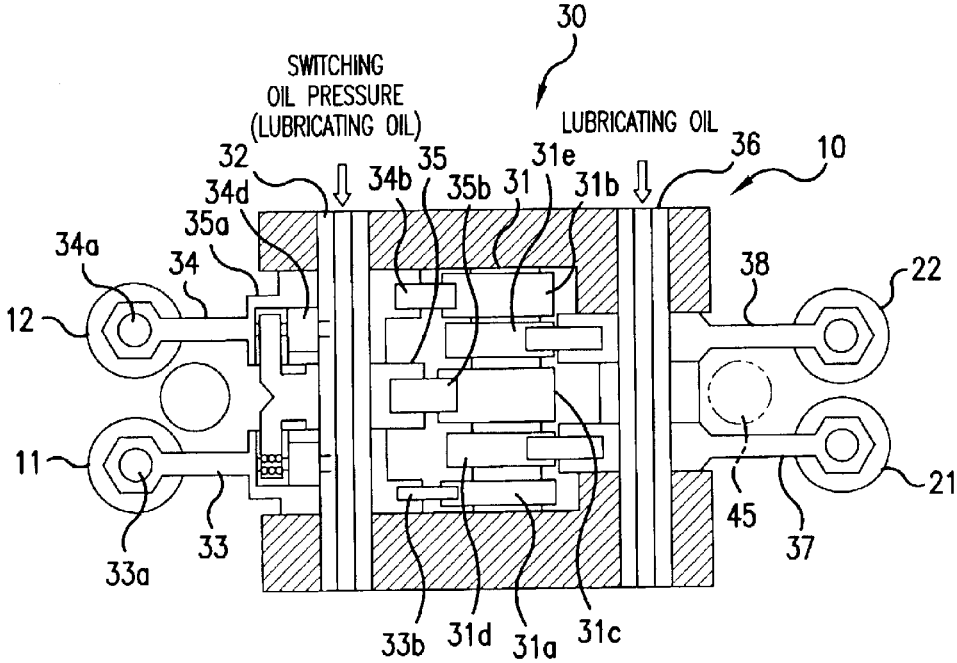
FIG. 4 is a sectional view (sectional view taken along the arrow IVC—IVC in FIG. 5) schematically showing the inside of a cylinder head in a valve system for an internal combustion engine according to a variation of the first and second embodiments of the present invention.
Figure 5:
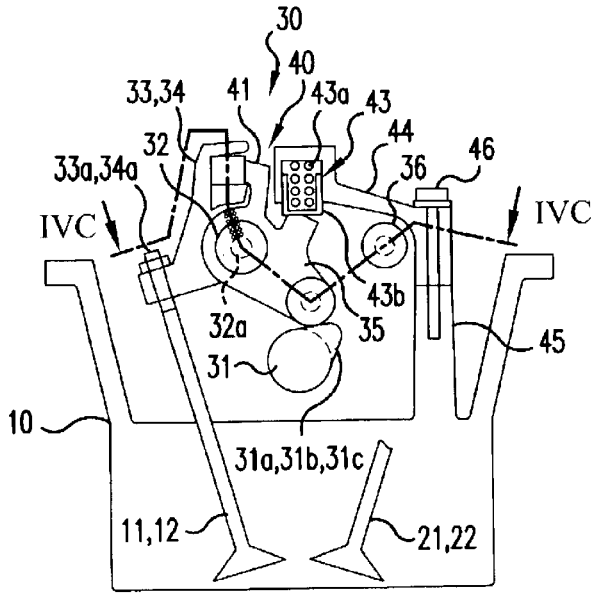
FIG. 5 is a side view schematically showing the inside of the cylinder head in the valve system for the internal combustion engine according to the variation of the first and second embodiments of the present invention.

A description will now be given of variations of the first and second embodiments of the present invention. FIGS. 4 and 5 show a first variation, wherein the arm spring 43 is provided as the forcing member that forces the rocker arm 35. The arm spring 43 is comprised of the spring main body 43*a* and the casing 43*b* having the arm spring 43*a* incorporated therein, such that the force of the spring main body 43*a* can be transmitted to the rocker arm 35 via the casing 43*b*. As indicated by an alternate long and two short dashes line in FIG. 4, the arm spring 43 is constructed such that a rib (support or projection) 45 is installed in a standing condition in a space formed in the upper part of the cylinder head 10 (in the periphery of the exhaust rocker shaft 36), and the holder 44 is screwed into and fastened in the support 45 by the fastening bolt 46.

Figure 6:
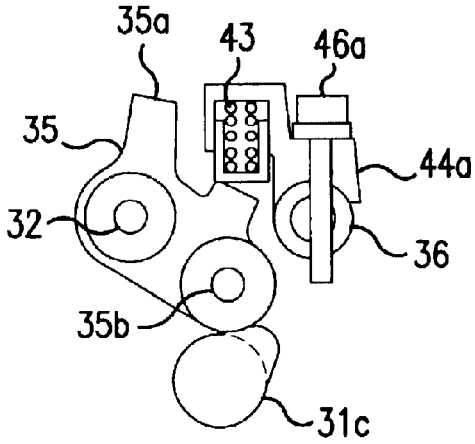
FIG. 6 is a side view schematically showing a second variation of the first and second embodiments of the present invention.

FIG. 6 shows a second variation of the first and second embodiments of the present invention, wherein a screw hole, into which a fastening bolt 46*a* is screwed, is pierced in the rocker shaft 36, and a holder 44*a* is directly fastened on the rocker shaft 36 by the fastening bolt 45*a*.

Although the first and second embodiments of the present invention have been described in some detail by way of illustration for purposes of clarity of understanding, it will be apparent that certain changes and modifications may be practiced within the scope of the claims.

For example, although in the above-described embodiments, the spring guard part 155 is provided, the present invention is not limited to this. The spring guard part 155 may be omitted insofar as there is no possibility that the engagement projection 35*a* is brought into contact with the return spring 152 in the piston 151. In this case, the engagement projection 35*a* is capable of moving in a wider range without interfering with the return spring 152.

Further, although in the above described first and second embodiments, the rocker arms 33, 34, and 133 driven by the low-speed cam are each provided with the cylinder, piston, and opening, and the rocker arms 35 and 135 driven by the high-speed cam are each provided with the engagement projection, the present invention is not limited to this. To the contrary, the rocker arms 33, 34, and 133 may be each provided with an engagement projection, and the rocker arms 35 and 135 may be each provided with a cylinder, piston, and opening.

A description will now be given of a third embodiment.

Figure 7A:
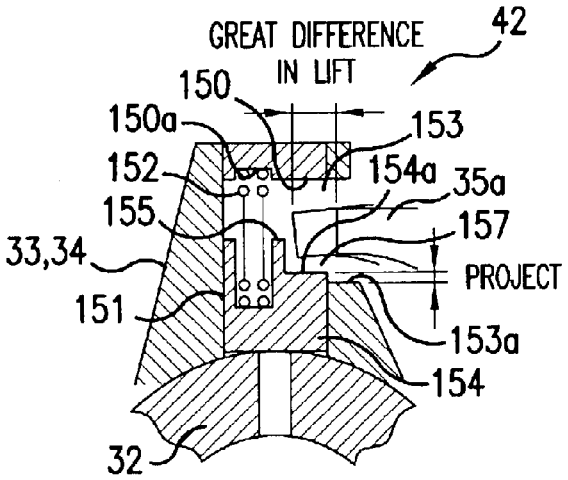
FIG. 7 is a set of sectional views schematically showing the essential parts (piston position switching device) of a valve system for an internal combustion engine according to a third embodiment of the present invention, wherein FIG. 7(*a*) is a longitudinal sectional view showing a state in which a piston is positioned at a disengagement position, FIG. 7(*b*) is a longitudinal sectional view showing a state in which the piston is positioned at an engagement position, and FIG. 7(*c*) is a cross-sectional view showing a state in which the piston is positioned at the engagement position (sectional view taken along the arrow VIIC—VIIC of FIG. 7(*b*))
Figure 7B:
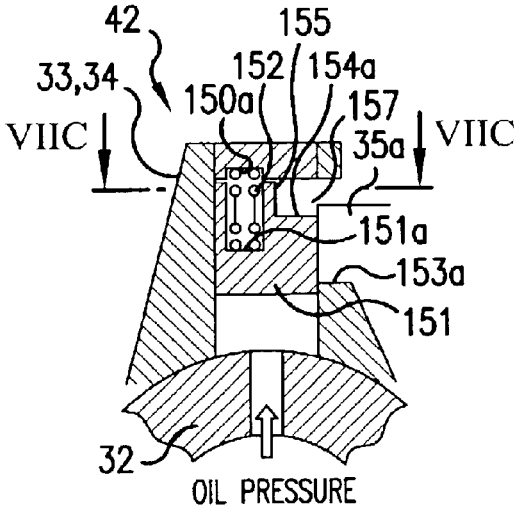
Figure 7C:
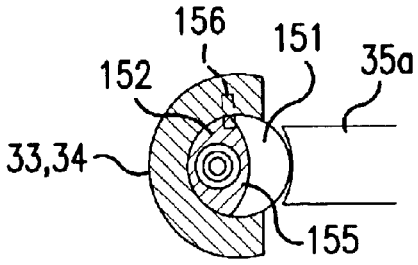

FIG. 7 is a side view schematically showing the inside of a cylinder head in a valve system for an internal combustion engine according to the present embodiment. In FIG. 7, elements and parts corresponding to those of FIG. 1 are denoted by the same reference numerals, and description thereof is omitted herein.

In the valve system according to the third embodiment, as shown in FIG. 7(*a*), when the piston 151 lies at the disengagement position, it is arranged that an end 154*a* of the engagement surface 154 of the piston 151 slightly projects beyond an edge face 153*a* forming the opening 153 of the cylinder 150 toward the opening 153.

Further, as shown in FIG. 7(*a*), above the engagement surface 154 of the piston 151, a notch (concave) 157 is formed adjacent to the upper end of the engagement surface 154. When the piston 151 lies at the disengagement position, the notch 157 is positioned inside the opening 153, such that the engagement projection 35*a* can move deep into the notch 157 without interfering with the piston 151.

Since the valve system for the internal combustion engine according to the third embodiment of the present invention is constructed as described above, effects as described below can be obtained in addition to the effects of the first embodiment.

Specifically, in the third embodiment, as shown in FIG. 7(*a*), when the piston 151 lies at the disengagement position, the end 154*a* of the engagement surface 154 of the piston 151 slightly projects beyond the edge face 153*a* forming the opening 153 of the cylinder 150 toward the opening 153, and hence the following effects can be obtained.

Specifically, it is assumed that at a time point the piston 151 has been slightly lifted, the engagement projection 35*a* is brought into local contact with the engagement surface 154 of the piston 151 to apply an excessive contact load to the engagement surface 154, and the end 154*a* of the engagement surface 154 is plastically deformed to expand beyond the outline of the piston 151.

In such an event, the plastically deformed end 154*a* projects toward the opening 153 of the cylinder 150 but does not enter the cylinder 150, and hence the end 154*a* of the engagement surface 154 is never caught on the edge face 153*a* forming the opening 153 of the cylinder 150.

Therefore, it is possible to prevent the deterioration of responsiveness in switching the position of the piston, and of course, it is also possible to prevent the problem that the piston is stuck to make it difficult to switch the position of the piston. As a result, it is possible to maintain a favorable switching performance of the oil pressure control unit (piston position switching device) 42, i.e., a favorable switching performance of the connection switching mechanism 41.

Moreover, it is possible to eliminate the possibility that the responsiveness in switching the position of the piston 151 is deteriorated due to the leakage of switching oil pressure through an increased piston clearance as in the case where the outer diameter of a piston is smaller than the inner diameter of a cylinder, and to prevent the piston 151 and the engagement projection 35*a* from being worn or deformed due to deterioration of responsiveness in switching the position of the piston 151.

Of course, since the end 154*a* of the engagement surface 154 projects only slightly beyond the edge face (edge) 153*a* of the opening 153 toward the opening 153, the end 154*a* never interferes with the engagement projection 35*a* moving into the opening 153 when the piston 151 lies at the disengagement position.

Conversely, the projecting amount of the end 154*a* of the engagement surface 154 must be set such that the end 154*a* never interferes with the engagement projection 35*a* moving into the opening 153 when the piston 151 lies at the disengagement position.

Figure 8A:
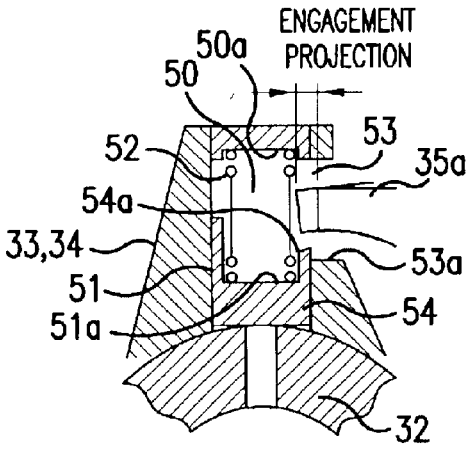
FIG. 8 is a set of sectional views schematically showing the essential parts (piston position switching device) of a valve system for an internal combustion engine according to the third embodiment, wherein FIG. 8(*a*) is a longitudinal sectional view showing a state in which the piston is positioned at the disengagement position, FIG. 8(*b*) is a longitudinal sectional view showing a state in which the piston is positioned at the engagement position, and FIG. 8(*c*) is a cross-sectional view showing a state in which the piston is positioned at the engagement position (sectional view taken on the arrow VIIIC—VIIIC of FIG. 8(*b*))
Figure 8B:
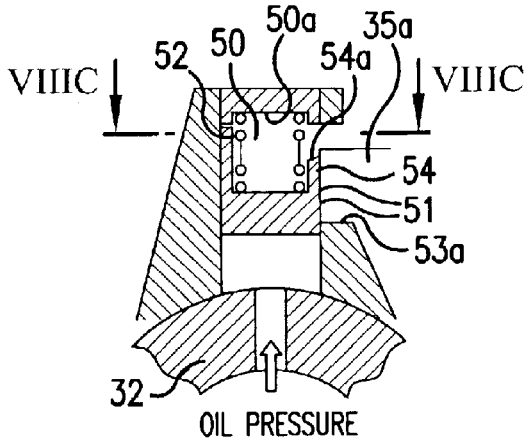
Figure 8C:
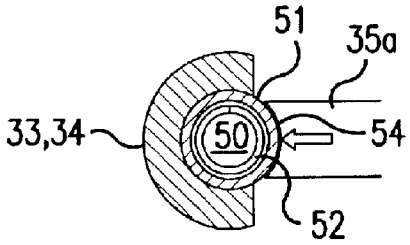

FIG. 8 is a sectional view (corresponding to FIG. 7) schematically showing the essential parts (piston position switching device) of a valve system for an internal combustion engine according to a fourth embodiment of the present invention. Note that elements and parts in FIG. 8 corresponding to those of FIG. 7 are denoted by the same reference numerals.

The valve system according to the present embodiment differs from those of the first and third embodiments in that a return spring 52 is not eccentric with respect to the axis of a piston 51 or a cylinder 50, but is similar to that of the third embodiment in that, as shown in FIG. 8(*a*), when the piston 51 lies at the disengagement position, an end 54*a* of an engagement surface 54 of the piston 51 slightly projects beyond an edge face 53*a* forming an opening 53 of the cylinder 50 toward the opening 53.

Further, as shown in FIG. 8(*a*), above the engagement surface 54 of the piston 51, a notch (concave) 57 is provided adjacent to the upper end of the engagement surface 54, and when the piston 51 lies at the disengagement position, the notch 57 is positioned inside the opening 53 such that the engagement projection 35*a* can move into the notch 57 without interfering with the piston 51.

Since the valve system for the internal combustion engine according to the fourth embodiment of the present invention is constructed as described above, as is the case with the third embodiment, even when the end 45*a* of the engagement surface 54 is plastically deformed to expand beyond the outline of the piston 51, the deformed end 54*a* projects toward the opening 53 of the cylinder 50 but does not enter the cylinder 50.

Therefore, the end 54*a* of the engagement surface 54 is never caught on the edge face 53*a* forming the opening 53 of the cylinder 50. As a result, it is possible to prevent the deterioration of responsiveness in switching the position of the piston, and of course, it is also possible to eliminate the possibility that the piston 51 is stuck to make it difficult to switch the position of the piston 51.

What is claimed is:

1. A valve system for an internal combustion engine, comprising:

a first rocker arm supported by a first rocker shaft such that the first rocker arm rocks when driven by a first cam, the first rocker arm having an end thereof connected to one of an intake valve and an exhaust valve;

a second rocker arm supported by the first rocker shaft such that said second rocker arm rocks when driven by a second cam having a different cam profile from that of the first cam, the second rocker arm disposed adjacently with respect to said first rocker arm;

a cylinder formed in one of said first and second rocker arms;

a piston slidably mounted in said cylinder;

an engagement projection that projects from the other one of said first and second rocker arms and selectively engages with an engagement part formed in said piston; and a piston position switching device that switches a position of said piston between an engagement position where said engagement projection is engaged with said piston and a disengagement position where said engagement projection is not engaged with said piston, said piston position switching device having a return spring that forces said piston to the disengagement position, and said return spring being disposed eccentrically with respect to said piston in such a direction as to get away from said engagement projection.

2. A valve system for an internal combustion engine according to claim 1, wherein said piston is formed with a concaved area where one end of said return spring is housed, a thick portion including the engagement part is formed on a side of said piston, with which said engagement projection is engaged, and around the concaved area of said piston, wherein the thick portion is positioned outside said cylinder when said piston is positioned at the engagement position, and the thick portion is housed in said cylinder when said piston is positioned at the disengagement position.

3. A valve system for an internal combustion engine according to claim 1, wherein said piston includes a cylindrical part where the thick portion is formed, and the engagement part formed in the thick portion has a cylindrical surface, and an abutment part of said engagement projection that abuts the engagement part is formed as a concaved surface along the engagement part.

4. A valve system for an internal combustion engine according to claim 1, wherein said return spring is an extension of a rocking path of said engagement projection relative to said piston, and a spring guard part positioned on an extension of a rocking path of said engagement projection to cover said return spring when said piston is positioned at the disengagement position is provided on a side of said piston with which said engagement projection is to be engaged.

5. A valve system for an internal combustion engine according to claim 4, wherein said spring guard part is formed as a cylindrical surface along the concaved surface of said engagement projection.

6. A valve system for an internal combustion engine according to claim 1, wherein an end of the engagement part of said piston projects projected from an end face of said piston when said piston is positioned at the disengagement position.

7. A valve system for an internal combustion engine according to claim 6, wherein a concaved area is formed in a part of said piston, which is positioned on a rocking path of said engagement projection when said piston is positioned at the disengagement position.

* * * * *